United States Patent [19]

Bobertag et al.

[11] 4,150,934

[45] Apr. 24, 1979

[54] APPARATUS FOR THE CHIP-FREE MANUFACTURE OF AXIALLY SYMMETRICAL SOLID BODIES OF VARIOUS DIAMETERS ALONG THEIR LONGITUDINAL EXTENSION, MADE OF A SOFT RESILIENT PLASTICS MATERIAL

[75] Inventors: Gerhard Bobertag, Hamburg; Bernfried Dihse, Norderstedt; Claus D. Harms, Hamburg; Uwe Gatzemann, Hamburg; Wilhelm Harms, Hamburg, all of Fed. Rep. of Germany

[73] Assignees: Bobertag und Häusler GmbH, Norderstedt; Gehörschutzcenter Wilhelm und Claus-Dieter Harms GmbH, Hamburg, both of Fed. Rep. of Germany

[21] Appl. No.: 861,019

[22] Filed: Dec. 15, 1977

[30] Foreign Application Priority Data

Dec. 16, 1976 [DE] Fed. Rep. of Germany ..... 2656939

[51] Int. Cl.[2] ..... B24C 17/00

[52] U.S. Cl. ..... 425/305.1; 425/385

[58] Field of Search ..... 425/305.1

[56] References Cited

U.S. PATENT DOCUMENTS

| | | | |
|---|---|---|---|
| 2,900,665 | 8/1959 | Walker | 425/305.1 X |
| 3,329,177 | 7/1967 | Bishop et al. | 425/305.1 X |
| 3,517,410 | 6/1970 | Rapisarda | 425/305.1 X |
| 3,517,415 | 6/1970 | McGrath et al. | 425/305.1 X |

*Primary Examiner*—J. Howard Flint, Jr.

*Attorney, Agent, or Firm*—Toren, McGeady and Stanger

[57] ABSTRACT

An apparatus for manufacturing axially symmetrical solid bodies such as ear plugs or sealing members made of a soft resilient expanded plastics foam material wherein a die adapted to cooperate with a cutting matrix for punch-pressing is provided with means for pre-stressing the punched foam material prior to the actual cutting operation for obtaining bodies of different shapes. This pre-stressing means may consist of a dowel, a recess or a curved surface at the die head and/or projections, bevel surfaces, vacuum chambers at the cutting table. The die may be cylindrical, annular, square or of any other desired configuration.

12 Claims, 19 Drawing Figures

APPARATUS FOR THE CHIP-FREE MANUFACTURE OF AXIALLY SYMMETRICAL SOLID BODIES OF VARIOUS DIAMETERS ALONG THEIR LONGITUDINAL EXTENSION, MADE OF A SOFT RESILIENT PLASTICS MATERIAL

The present invention relates to an apparatus for the chip-free manufacturing of axially symmetrical solid bodies of various diameters along their longitudinal extension, made of a soft resilient plastics foam material, in employing cutting tools for punch-pressing a portion of a plate of soft resilient foam material compressed in the cutting region by a die.

It is an object of the present invention to provide a novel and improved apparatus of the above indicated type.

It is another object of the present invention to provide a novel and improved apparatus of the above stated type which apparatus allows to manufacture, in a simple manner and economically, axially symmetrical solid bodies of various diameters, without interfering with the resilient properties of the desired solid bodies such as by destroying the cellular structure.

In accordance with the present invention, this object is achieved by the expedient of means arranged at a face of a die portion associated with an aperture in a cutting plate, this means being disposed coaxially of the center axis of the die and adapted to be operatively coupled with an end portion cooperating with the die of the aperture in the cutting plate to pre-stress a foam material blank intended to be severed.

The apparatus of the present invention is particularly advantageous for manufacturing sound attenuating ear plugs in the form of axially symmetrical solid bodies with end portions of a conical configuration. The material of these solid bodies preferably consists of a mixed-cell type foam material having a high proportional content of closed-pore type cells made of a physiologically acceptable thermoplastic plastics material. Ear plugs of the proposed type may be readily inserted into the auditory canal of the human ear, in adapting themselves to the configuration of this auditory canal, without requiring to be compressed before being inserted, and this advantageous behaviour is due to the conical arrangement of the plug wall portions. In this manner may be avoided that the ear plugs become soiled during repeated usage particularly by persons working in factories or the like. If the ear plugs nevertheless should get dirty, the plugs may be cleaned quickly and efficiently.

In the following, the present invention will be described more in detail with reference to various embodiments shown in the appended drawings. The drawings illustrate an apparatus for carrying out the invention and several embodiments of ear plugs of various shapes.

In the drawings

Figure 9:
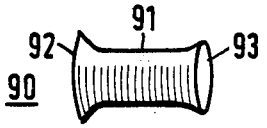
Figure 10:
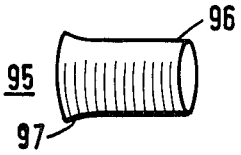
Figure 11:
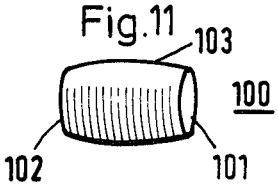
Figure 8E:
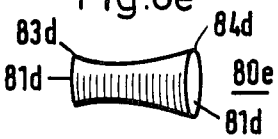
Figure 13:
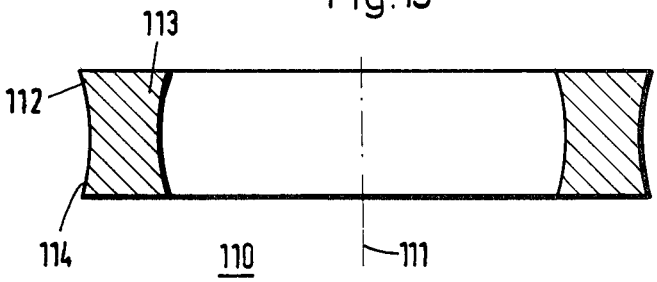
Figure 14:
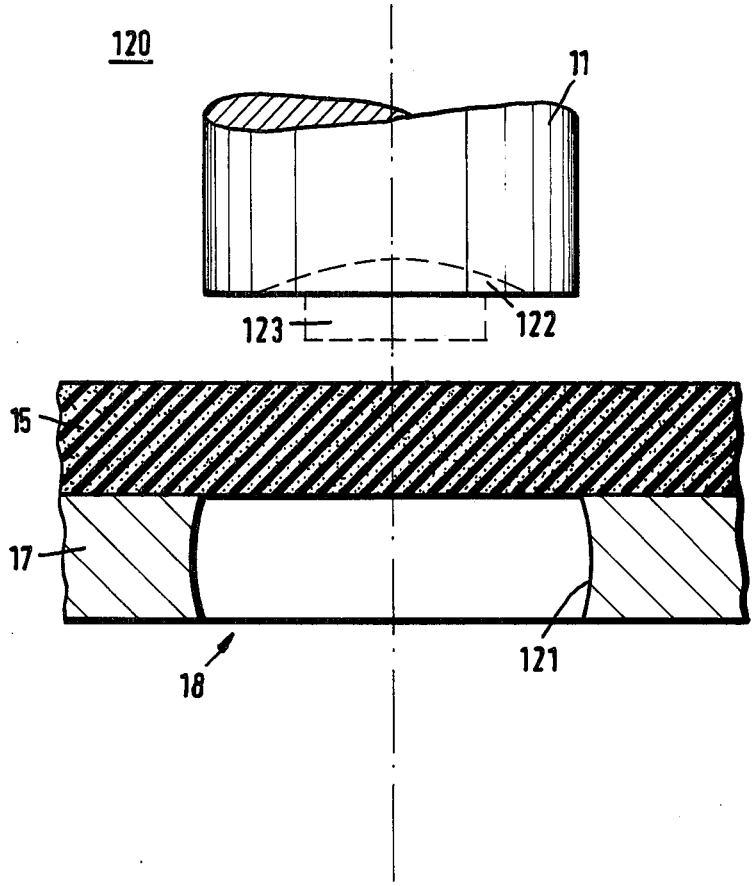

FIGS. 8*a* to 8*e* are schematical lateral elevational views of axially symmetrical solid bodies of soft resilient foam material, the bodies having two end faces of various diameters and a wall surface including two oppositely conical tapered portions;

FIG. 9 is a lateral elevational view of a solid body of the type shown in FIGS. 8*a* to 8*e* but with a cylindrical intermediate wall portion merging into two opposite differently tapered conical end portions;

FIG. 10 is an elevational view of a solid body of the type shown in FIGS. 8*a* to 8*e* but with a cylindrical wall surface and a conical enlargement at one end portion;

FIG. 11 is an elevational view with a spherical wall surface;

FIGS. 12*a* and 12*b* are lateral elevational views of conically shaped solid bodies;

FIG. 13 is a sectional elevational view of an annular solid body made of a soft resilient foam material, the wall cross-section of the body including two portions of opposite curvatures; and FIG. 14 is a schematical lateral elevational view of a punching assembly with a cutting plate having an aperture of a concave cross-sectional configuration.

Figure 1:
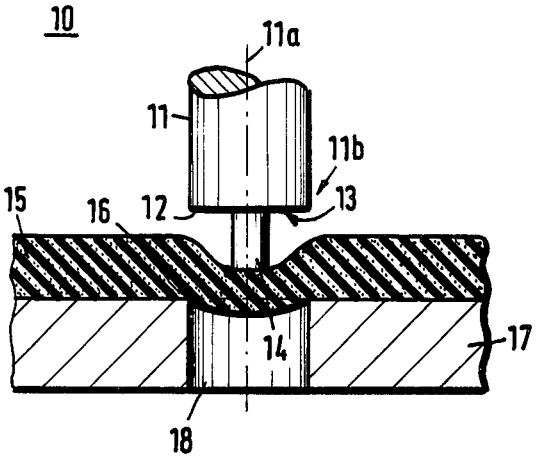
FIG. 1 is a fragmentary lateral elevational view of a punching assembly with a pre-stressing dowel projecting from the cutting face of the die, in accordance with a first embodiment of the present invention.

Referring to FIG. 1, there is shown a punching assembly 10. This punching assembly includes a cutting plate 17 with an aperture 18. A die 11 is associated with the aperture 18. A dowel 14 is provided at the face 13 of the die 11, the dowel being disposed coaxially of the center axis 11*a* of the die. The diameter of the dowel 14 is smaller than the diameter of the die 11. By this dowel 14, a region of a soft resilient foam material 15 resting on the cutting plate 17 may be pre-stressed into the aperture 18 when the die 11 is displaced downwardly toward the cutting plate until the cutting edge 12 of the die shears off a foam material blank (not shown).

Figure 2:
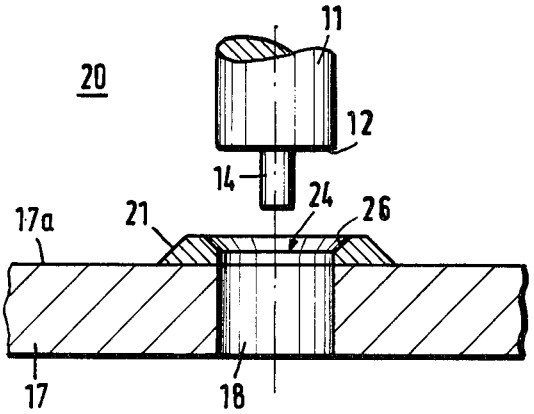
FIG. 2 is a fragmentary schematical lateral elevational view of another embodiment of a punching assembly including a projecting rim coaxial of the die on the cutting plate.
Figure 3:
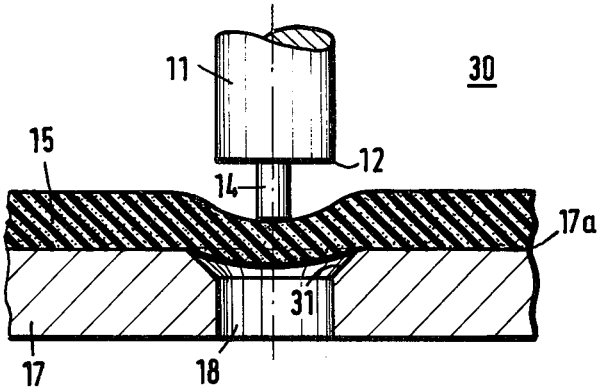
FIG. 3 is a fragmentary schematical lateral elevational view of another punching assembly with bevels at the aperture of the cutting plate.

In the punching assembly 20 shown in FIG. 2 an annular projecting rim 21 is arranged coaxially of the center line of the aperture 18 in the cutting plate 17 on the support surface 17*a* for the plate 15 of soft resilient foam material. The annular projecting rim 21 includes a conically tapered wall surface 26 extending toward the aperture 18. When prestressing the foam material by lowering the die 11, foam material will be pulled into the aperture 18 from a region of the plate 15 of soft resilient foam material surrounding the rim 21 until the cutting edge 12 of the die 11 cooperates with a cutting edge 24 on the cutting plate 17. A similar effect will be achieved by providing the aperture 18 with a bevel 31 adjacent the support surface 17*a* (FIG. 3). In the punching apparatus 30 shown in FIG. 3 the amount of foam material that may be pulled, during pre-stressing, into the aperture 18 from a region of the plate 15 of soft resilient foam material surrounding this aperture may be adjusted as desired by varying the size of the bevel or the angle of the bevel with respect to the center axis of the aperture 18.

Figure 4:
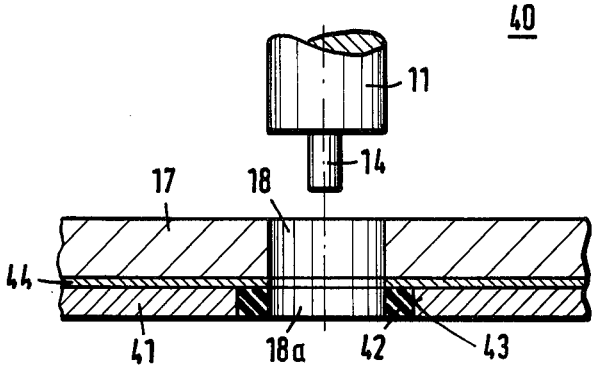
FIG. 4 is a schematical lateral elevational view of a punching assembly with a cutting plate including a heating element.

In FIG. 4 is shown a punching assembly 40 having an annular heating element 42 associated therewith at the cutting plate 17. The annular heating element 42 circumscribes the outlet port of the aperture 18. A center aperture 18*a* of the heating element 42 is disposed coaxially of the aperture 18. The heating element 42 is retained by a support plate 41. A heat insulating layer 44 is arranged intermediate the support plate 41 or respectively the heating element 42 and the cutting plate 17. During pre-stressing the foam material of the plate 15 by lowering the die 11 toward the cutting plate, the foam material which is being pre-stressed by the dowel 14 may be heated, in the vicinity of the heating element 42, to a temperature at which individual cell walls will fluidize and thereby the volume of the foam material will decrease. By this expedient may be modified, in a desired manner, the shape of one end portion of a solid body that is produced by this punching operation.

Figure 5:
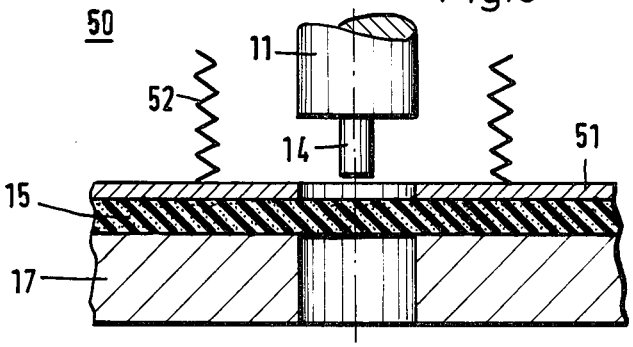
FIG. 5 is a schematical lateral elevational view of a punching assembly with a spring biased press pad.

In the punching assembly 50 shown in FIG. 5 the plate 15 of soft resilient foam material is pre-stressed by a holding down device in the form of a press pad 51 biased by springs 52, prior to punching by means of a die 11 bearing at its head a dowel 14. When pre-stressing the foam material, a relatively small amount of foam material may be pulled into the aperture 18 from the regions of the plate 15 adjacent the aperture 18, in avoiding to obtain solid bodies having mushroom shaped end portions.

Figure 6:
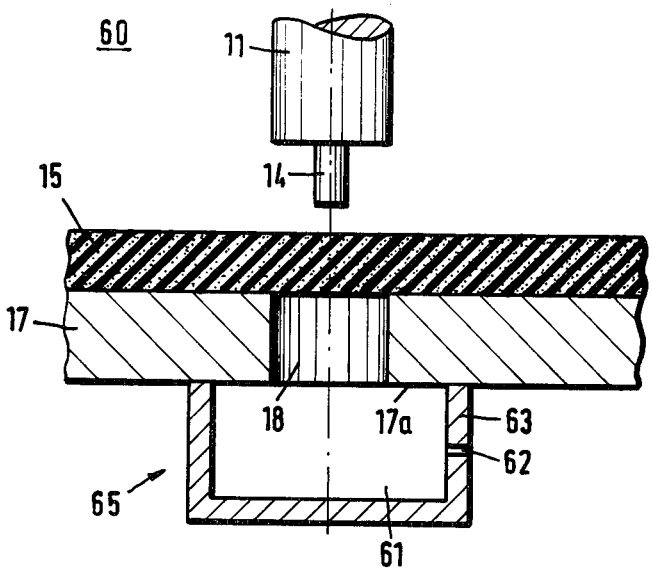
FIG. 6 is a schematical lateral elevational view of a punching assembly with a vacuum chamber at the lower surface of the cutting plate.

In the punching assembly 60 shown in FIG. 6 a well 65 is provided at the lower surface 17*a* of the cutting plate 17 in the vicinity of the aperture 18. The well 65 defines a chamber 61. The walls 63 of the chamber are provided with an opening 62 for applying a vacuum to the chamber. When utilizing closed-pore type foam material, a vacuum may be applied to this material before performing the punching operation so that air that is trapped within the cells of the foam material will be at least partially withdrawn from these cells, in reducing the risk of tearing the material. This risk is usually encountered during pre-stressing. Upon termination of the punching operation, the foam material samples are again exposed to ambient atmospheric pressure and will assume their final shapes after pressure equalization by air that diffuses into the cells.

Figure 7:
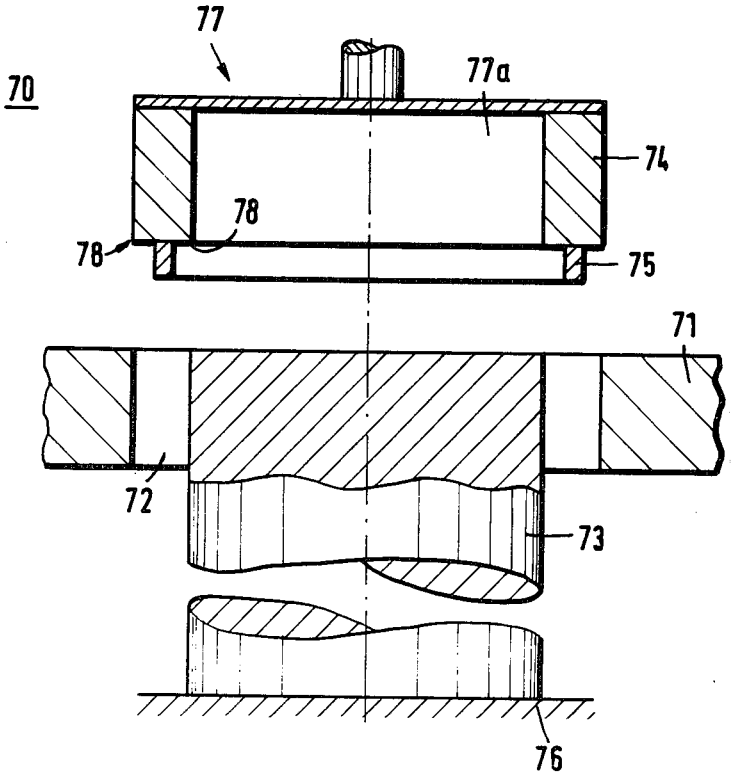
FIG. 7 is a schematical lateral elevational view of a punching assembly for manufacturing circular solid bodies of soft resilient foam material.
Figure 8:
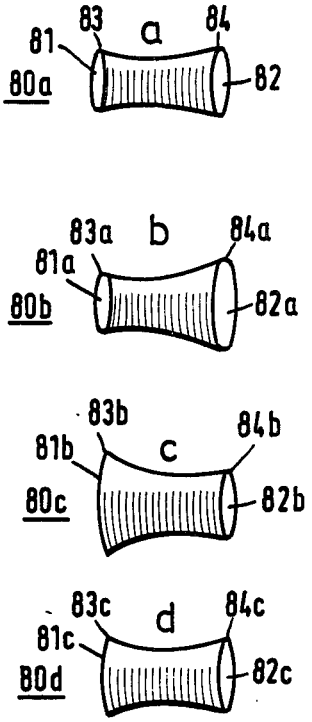

It is likewise feasible to produce, in accordance with the present invention, e.g. annular solid bodies for e.g. sealing purposes or the like. Toward this purpose may be provided a punching assembly 70 of the type shown in FIG. 7. This punching assembly includes a die 77 having a peripheral cutting edge 78 and a recess 77*a*. The depth of the recess 77*a* substantially corresponds to the thickness of the cutting plate 71. In the cutting plate 71 is provided a circular aperture 72 that substantially corresponds to the projection of the cutting edge 78 of the die on the cutting plate. The width of the aperture 72 corresponds to the width of the cutting edge 78 of the die 77. When being lowered, the die 77 may be introduced into the aperture 72. For increased pre-stressing effects, a peripheral annulus 75 may be provided. This annulus projects downwardly from the cutting edge 78 of the die 77. The thickness of this peripheral annulus 75 is smaller than the thickness of the side wall 74 of the die 77. The aperture 72 in the cutting plate 71 may be arranged so that in a large annular aperture a central die may be provided and the clearance between the die and the cutting plate 71 may form the aperture 72. The portion of the die 73 that is disposed below the cutting plate 71 may serve to receive the punched annular solid bodies and may be mounted on a support plate 76 that may be disassembled from the cutting plate 71.

FIGS. 8 to 13 illustrate various embodiments of solid bodies manufactured in accordance with the present invention. The solid bodies shown in FIGS. 8 to 12 may be employed e.g. as ear plugs. The solid bodies 80*a* to 80*e* of FIGS. 8*a* to 8*e* each comprise two mutually opposed conically tapered end portions 83, 83*a*, 83*b*, 83*c*, 83*d*; 84, 84*a*, 84*b*, 84*c*, 84*d* wherein merely the diameters of the end faces 81, 81*a*, 81*b*, 81*c*, 81*d*; 82, 82*a*, 82*b*, 82*c*, 82*d* are of different sizes. The solid body 9 of FIG. 9 includes a cylindrical intermediate portion 91 and two end portions 92, 93 with oppositely directed conical tapers. The solid body 95 shown in FIG. 10 consists of a cylindrical portion 96 and a unilateral integral conical end portion 97. The solid body 100 shown in FIG. 11 includes a spherical wall surface 103. The faces 101, 102 of this body are of equal size. A solid body 100 made of soft resilient foam material such as the body 100 may be manufactured advantageously in a punching assembly 120 of the type shown in FIG. 14. The cutting plate 17 of this punching assembly 120 includes an aperture 18 with a concavely curved peripheral wall 121. When pre-stressing the plate 15 of soft resilient foam by means of the die, the foam material is being pulled into the concave recess of the aperture 18 so that by this punching operation will be obtained a solid body 100 having a spherical wall surface 103 in its fully expanded shape. The face 13 of the die 11 may be plane or may be provided with a central recess 122 or with a projecting dowel 123, depending upon the desired final shape of the solid body 100 and the type of the soft resilient foam material employed.

Figure 12:
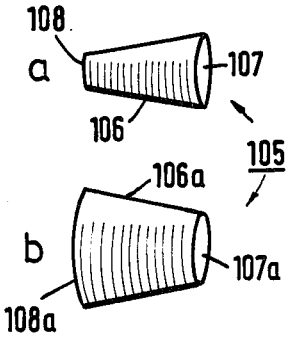

In FIGS. 12*a* and 12*b* are shown solid bodies 105 with conical wall portions 106, 106*a* and end surfaces 107, 108, 107*a*, 108*a* of different sizes. The ear plugs shown in FIGS. 8 to 12 may be compressed readily when being made of a mixed cell type soft resilient thermoplastic foam material. On termination of compressive forces, the plugs will restore their initial shape within a short period of time.

In FIG. 13 is illustrated a solid body 110 which is symmetrical with respect to the center axis 111. In the cross-sectional view, the annular elements of this solid body 110 are of a shape corresponding approximately to the shape of the solid bodies shown in FIGS. 8*a* to 8*e*. Two oppositely tapered conical end portions 112, 114 are integrally connected to provide the cross-sectional area of an annular element 113.

The tests described in the following have been performed with punching assemblies wherein the diameters of the dies and the diameters of the apertures in the cutting plates were unchanged throughout the tests.

TEST 1

This test was performed in employing the punching assembly shown in FIG. 1. With a closed-pore type soft resilient foam material a severed foam material blank turns inside out and tears. Mixed-cell type thermoplastic soft resilient foam material with closed pores in a proportion of about 60% allows to produce an axially symmetrical solid body with two oppositely tapered end portions. The diameter of one end portion is larger than the diameter of the other end portion. The solid body is relatively thick. When increasing the pre-stressing effects by varying the length of the dowel, the diameter of the mushroom shaped end portion is increased and vice versa.

TEST 2

This test was performed in employing a die with a spherical die head (of a large radius of curvature). There is again obtained a solid body with oppositely tapered conical end portions. Whereas the diameter of one of the two end portions remains constant, the diameter of the other of the two end portions increases with an increased speed of die movement. When employing mixed-cell type foam material, substantial deformations will be obtained. The compressed blank expands slowly.

TEST 3

A die with a beveled die head is employed. With mixed-cell type foam foam and a high die movement rate the sample is strongly compressed and expands only slowly. When employing closed-cell type foam material there is obtained immediately a solid body with oppositely tapered conical end portions, without tearing the sample.

TEST 4

When employing a sleeve type die with a central recess there may be obtained solid bodies without cracks or tearing with oppositely tapered conical end portions from mixed-cell type as well as closed-cell type soft resilient foam materials.

TEST 5

When employing a die with a conical die tip and a cone angle of 30° wherein the cone tip is somewhat rounded, a sample of closed-cell type foam material turns inside out and tears whereas a sample made of mixed-cell type foam material initially deforms strongly without tearing or cracks and subsequently rapidly expands into an axially symmetrical solid body with oppositely tapered conical end portions. The end faces are of relatively large diameters.

TEST 6

Foam material that has been pre-stressed by means of the dowel depending from the die is heated, in a lower cutting plate region, up to the melting temperature of the foam material. After cooling down and terminating the punching operation there is obtained a conical solid body since the cells exposed to heat of the solid body have collapsed due to melting.

TEST 7

Before the punching operation, the plate of soft resilient foam material is compressed by means of a holding down pad. By the punching process will be obtained samples of an approximately cylindrical configuration.

These tests reveal that the outer geometrical configuration of solid bodies made of soft resilient foam material may be predetermined, to a certain degree, when employing mixed-cell type foam materials and partly likewise closed-cell type foam materials, by varying the amount of pre-stressing and/or the pre-stressing before the actual cutting operation is performed by cooperative action of die and cutting plate. Particularly when manufacturing articles in larger sizes, an additional usage of heating elements or vacuum chambers may be advantageous. Since in mixed-cell type foam materials the pores partly communicate with each other, these bodies may generally be pre-stressed without requiring any special pre-treatment and without incurring the risk of tearing or any other undesired effects. Due to possible distortions of the cellular structure by the discharge of air from the open pores, a tension equalization occurs in mixed-cell type foam materials. In closed-cell type foam materials the tension equalization is often possible only after a previous pores degassing treatment under vacuum.

The present invention further allows to produce an axially symmetrical solid body 110 as well as a solid body 100 with a spherical wall surface 103 by means of the punching assembly 70. The shape of the solid body 100, particularly the ratio of length to diameter of the body is thereby dependent upon the ratio of the inner diameter of the annular wall 74 of the die 70 to the thickness of the plate of soft resilient foam material 15 as well as the thickness of the cutting plate 71.

For obtaining configurations other than annular configurations of the punched foam material solid bodies it would likewise be possible to provide the die 11 and the aperture 18 in the cutting plate 17 in a non-circular shape such as e.g. in a square, rectangular, oblong or any other desired configuration so as to allow the manufacture of foam material solid bodies of different respective shapes.

What is claimed is:

1. An apparatus for the chip-free manufacturing of axially symmetrical solid bodies of various diameters along their longitudinal extension, made of a soft resilient plastics foam material, in employing cutting tools for punch-pressing a portion of a plate of soft resilient foam material compressing in the cutting region by a die, said apparatus being characterized by means arranged at a face (13) of a die portion associated with an aperture (18) in a cutting plate (17), said means being disposed coaxially of the center axis of said die and adapted to be operatively coupled with an end portion cooperating with said die (11) of said aperture (18) in said cutting plate (17) to pre-stress a foam material blank intended to be severed.

2. An apparatus as defined in claim 1 wherein a dowel (14) is arranged at the face (13) of said die, said dowel being of a diameter smaller than the diameter of said die.

3. An apparatus as defined in claim 1, wherein the face (13) of the die includes an integral spherical portion extending to a peripheral cutting edge of said die.

4. An apparatus as defined in claim 1, wherein the face **(11*b*) of the die (11) includes a recess so as to define a plane annular cutting surface extending perpendicularly of said die center axis (11*a*)**.

5. An apparatus as defined in claim 1 wherein the aperture end portion (18) of said cutting plate (17) adapted to cooperate with said die (11) is provided with a bevel portion.

6. An apparatus as defined in claim 1 wherein an annular projecting ring (21) having a conically tapered wall surface (26) extending toward said aperture (18) is provided at a support surface **(17*a*) of said cutting plate (17) cooperating with said die (11)**.

7. An apparatus as defined in claim 1 wherein an end portion of said aperture (18) remote from said plate of soft resilient foam material (15) is circumscribed by a controllable heating element (42) separated from said cutting plate (17) by heat insulating means (44).

8. An apparatus as defined in claim 1 wherein a well (65) defining an internal chamber (61) is provided at the side of the cutting plate (17) remote from said die (11), said well being adapted to provide a vacuum.

9. An apparatus as defined in claim 1 wherein is provided a punching assembly (70) having a die (77) with a recess (77*a*) of a depth corresponding approximately to the thickness of said cutting plate (71), in defining a peripheral cutting edge (78), in said cutting plate (71) a peripheral aperture (72) mating the projection of the peripheral cutting edge (78) of said die, said aperture (72) being of a width corresponding substantially to the width of the cutting edge (78) of said die (77) and being adapted to be operatively associated with said die cutting edge (78).

10. An apparatus as defined in claim 1 wherein the cutting plate (17) is provided with an aperture (18) having a concavely curved side wall (121).

11. An apparatus as defined in claim 1 wherein said plate (15) of a mixed cell type foam material is made of polyethylene, polyvinyl chloride, polystyrene, polypropylene or polyurethane and comprises a high proportion of closed cells.

12. An apparatus as defined in claim 11 wherein the proportion of closed cells in the soft resilient foam material amounts to approximately 60% by volume.

* * * * *